United States Patent [19]

Wildenradt

[11] Patent Number: 4,709,566

[45] Date of Patent: Dec. 1, 1987

[54] SINGLE CYLINDER DEADBOLT LOCK MECHANISM

[76] Inventor: Carl H. Wildenradt, 2358 - 35th Ave., San Francisco, Calif. 94116

[21] Appl. No.: 927,517

[22] Filed: Nov. 6, 1986

[51] Int. Cl.[4] ..... E05B 65/6

[52] U.S. Cl. ..... 70/129; 70/133; 70/DIG. 42

[58] Field of Search ..... 70/416, DIG. 42, 129, 70/133, 134

[56] References Cited

U.S. PATENT DOCUMENTS

| | | | |
|---|---|---|---|
| 527,560 | 10/1894 | Rumsey . | |
| 584,697 | 6/1897 | Morris . | |
| 1,000,527 | 8/1911 | Lee . | |
| 1,148,526 | 8/1915 | Muscarella . | |
| 1,377,737 | 5/1921 | Stosech . | |
| 1,956,388 | 4/1934 | Kalina | 70/16 |
| 2,463,195 | 3/1949 | Morgan | 70/416 |
| 2,978,267 | 4/1961 | North et al. | 292/169 |
| 3,593,548 | 7/1971 | Kendrick | 70/129 |
| 3,685,036 | 8/1972 | Torok | 340/274 |
| 3,950,970 | 4/1976 | Fortin | 70/63 |
| 4,047,408 | 9/1977 | Johns et al. | 70/129 |
| 4,064,721 | 12/1977 | Morgan | 70/416 |
| 4,290,282 | 9/1981 | Wildenradt | 70/129 |

*Primary Examiner*—Robert L. Wolfe

*Attorney, Agent, or Firm*—Victor R. Beckman

[57] ABSTRACT

A lock mechanism is shown having a latch bolt movable between retracted and extended positions, which latch bolt is operated by rotation of a lock cylinder at one side and a turn piece at the opposite side. A manually movable latching member operable from said opposite side of the lock mechanism is movable between a first position where operation of the latch bolt by the turn piece is prevented, and a second position where operation of the latch bolt by the turn piece is permitted. A combination lock operable from said opposite side of the lock mechanism may be used to lock the latching member in the first position thereof wherein operation of the latch bolt by the turn piece is prevented. With the combination lock set to the lock-open combination, movement of the latching member between said first and second position is permitted.

9 Claims, 5 Drawing Figures

SINGLE CYLINDER DEADBOLT LOCK MECHANISM

FIELD OF THE INVENTION

This invention relates generally to single cylinder deadbolt lock mechanisms having a turn piece at one side thereof.

BACKGROUND OF THE INVENTION

Single cylinder deadbolt lock mechanisms that include a cylinder lock at one side thereof and a turn piece at the opposite side are, of course, well known. Conventional locks of this type provide for extending and retracting the latch bolt by use of either the lock cylinder or the turn piece. A recognized disadvantage of such lock mechanisms is that a burglar or other such unauthorized person who gains entry to a building may easily exit the same through the door after simply unlocking the same from the inside by use of the turn piece. For doors with windows, entry to the building is readily gained after first breaking the window then unlocking the door from the inside thereof. Although double cylinder deadbolt locks often are used to prevent such easy exit from a building, they are more expensive than single cylinder locks and, in the case of fire or other emergency, may prevent quick egress from the building. In some cases, local ordinances prohibit the use thereof at the primary entrance to the dwelling.

Additionally, single cylinder deadbolt lock mechanisms are known wherein the turn piece is rendered inoperative when the latch bolt is moved into locking position by key operation of the lock cylinder. Such a lock mechanism is shown in U.S. Pat. No. 2,178,666 issued to O. C. Larson. As with the above-mentioned prior art single cylinder locks of this general type, a major disadvantage of such an arrangement is that the door can not be opened from the inside using the turn piece after being locked by use of the key from the outside. Any authorized person in the building could not exit through the door once the door is locked by operation of the lock cylinder. An arrangement which avoids this disadvantage is shown in U.S. Pat. No. 4,047,408 issued to Eddie D. Johns, et al. wherein the turn piece is selectively rendered inoperable when the cylinder lock is operated by the key. With this arrangement, if the key is depressed while locking the door, the turn piece is rendered inoperative and, if not depressed, the turn piece remains operative. Major disadvantages of such an arrangement include the complexity and cost of manufacturing the same which greatly limit the marketability thereof. Also, the turn piece disabling mechanism is operated from the cylinder side of the lock rather than from the turn piece side thereby contributing to the complexity of the prior art mechanisms. In U.S. Pat. No. 4,290,282 issued to the present inventor, the turn piece is selectively rendered inoperable when the cylinder lock is operated by the key by means of a disabling mechanism that is operated from the turn piece side of the door. Again, if the turn piece has been disabled, operation of the latch bolt by the turn piece is prevented until the lock is unlatched by operation of the key.

OBJECTS AND SUMMARY OF THE INVENTION

An object of this invention is the provision of an improved single cylinder deadbolt lock mechanism with a turn piece which avoids the above-mentioned and other shortcomings and disadvantages of prior art single and double cylinder deadbolt lock mechanisms.

An object of this invention is the provision of an improved single cylinder deadbolt lock mechanism with turn piece which is of extremely simple design, which may incorporate many standard lock components, and which costs very little more to manufacture than conventional single cylinder deadbolt lock mechanisms with turn piece which is always enabled.

An object of this invention is the provision of an improved single cylinder deadbolt lock mechanism with turn piece which may, essentially, be operated either as a conventional single cylinder deadbolt lock or as a double cylinder deadbolt lock depending upon the condition of locking means at the turn piece side of the mechanism.

The above and other objects and advantages of this invention are achieved by use of a latch bolt movable between extended and retracted positions by use of spindle bar means connected thereto. A lock cylinder with a rotatable plug, located at one side of the mechanism, is coupled through a lost-motion connection to the spindle bar means for key operation of the latch bolt between retracted and extended positions. A turn piece at the opposite side of the lock mechanism is coupled to the spindle bar means through another lost-motion connection for turn piece operation of the latch bolt between retracted and extended positions. Manually movable means operable from said opposite side of the lock mechanism are movable between a first position for preventing operation of the latch bolt by operation of the turn piece and a second position allowing for operation of the latch bolt by the turn piece. A lock, such as a combination lock, operable from said opposite side of the lock mechanism is operable in the locked condition thereof for locking the manually movable means in said first position wherein operation of the latch bolt by the turn piece is prevented. Operation of the latch bolt by the turn piece by unauthorized persons is thereby prevented, when desired, yet the turn piece may be rendered operable at any time by an authorized person from said opposite side of the lock mechanism.

BRIEF DESCRIPTION OF THE DRAWINGS

The invention, together with other objects and advantages thereof will be better understood from the following description considered with the accompanying drawings. In the drawings, wherein like reference characters refer to the same parts in the several views.

Figure 1:
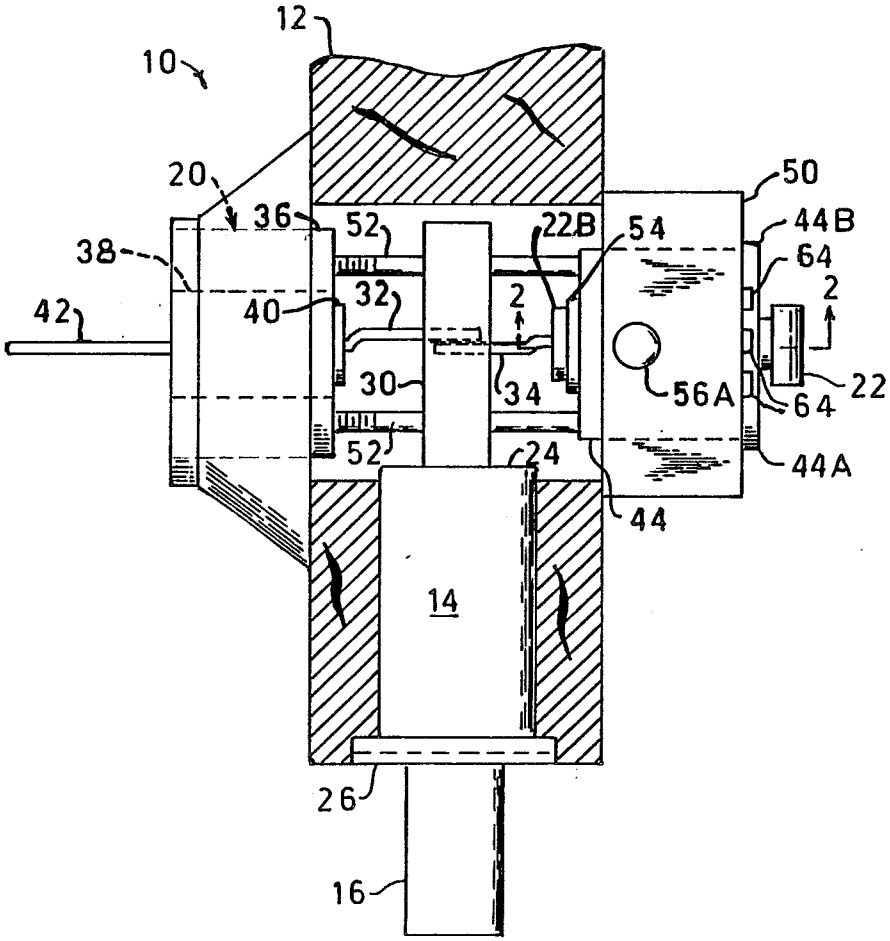
FIG. 1 is a frogmentary sectional view through a door and showing a top view ofa lock mechanism which embodies the present invention; the latch bolt of the lock mechanism being shown in extended locking position.

Reference first is made to FIG. 1 of the drawings wherein the novel lock mechanism 10 of this invention is shown installed on a door 12. The lock mechanism 10 includes a latch unit 14, which may be of conventional design, and which includes a latch bolt 16 movable into and out of engagement with an aperture in a strike plate, not shown, by operation of a cylinder lock 20 at the outer face of the door or a thumbturn, or turn piece, 22 at the inner face thereof.

Latch unit 14, which, as noted above, may be of conventional design, includes a cylindrical shaped housing 24 and a face plate 26 at the outer end of the housing formed with an aperture in the shape of the latch bolt cross-section into which the latch bolt extends for slideable support thereat. Screws, not shown, secure the face plate 26 to the edge of the door at a mortice formed therein.

A latch bar supporting member, or housing, 30 is fixedly attached to the rear, or inner, wall of the housing 24 and extends rearwardly thereof. A latch bar, not shown, is fixedly secured to the rear of the latch bolt 16 and extends rearwardly thereof into housing 30. The latch bar is movable forwardly and rearwardly by a crank, or actuating lever, not shown, inside housing 30. Spring means, not shown, provide a snap-over action for resiliently biasing the crank in either rotary direction depending upon which side of dead-center position the crank is located. The crank is non-rotatably coupled to spindle bar means 32 and 34 whereby the latch bolt 16 is movable between retracted and extended positions upon rotation of the crank by either spindle bar means 32 or spindle bar means 34.

Cylinder lock 20, which also may be of conventional design, includes a housing 36 containing a tumbler cylinder 38 in which a cylinder plug 40 is rotatably mounted through use of a key 42. A lost-motion connection, not shown, of conventional design, connects the cylinder plug 40 to spindle bar means 32 for drive rotation thereof. As is well understood the lost-motion connection allows for return rotation of the key 42 to a position allowing removal of the key from the cylinder plug without corresponding rotation of the spindle bar means following key locking and unlocking operations. With the key 42 inserted in the cylinder lock 20, spindle bar means 32 may be rotated in one direction for extension of the latch bolt 16 into locking position, shown in FIG. 1. Rotation of the spindle bar means 32 in the opposite direction returns the latch bolt 16 to retracted, unlocked, position, not shown. With the present arrangement, the latch bolt 16 is movable between retracted and extended positions by means of the cylinder lock 20 for both locking and unlocking operations regardless of the operative condition of turn piece 22 at the opposite side of the mechanism. That is, turn piece 22 may be in either locked or unlocked condition, yet latch bolt 16 may be extended and retracted by operation of cylinder lock 20.

Figure 2:
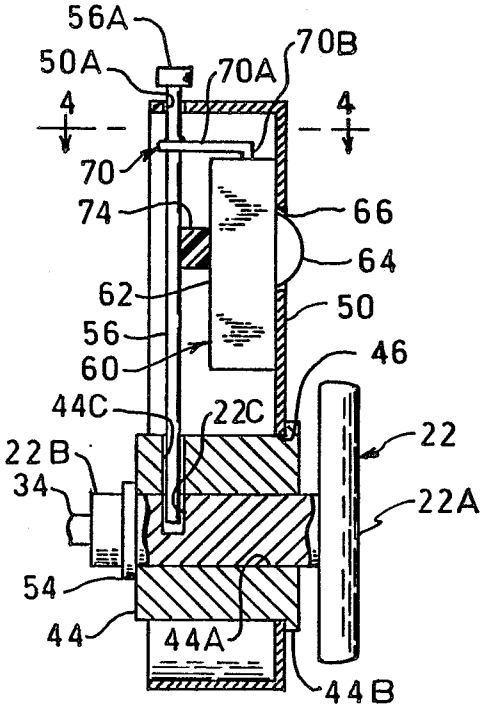
FIG. 2 is a fragmentary sectional view of the turn piece portion of the lock mechanism taken substantially along line 2—2 of FIG. 1 and showing the turn piece in an inoperative condition wherein it is prevented from operating the latch bolt.
Figure 5:
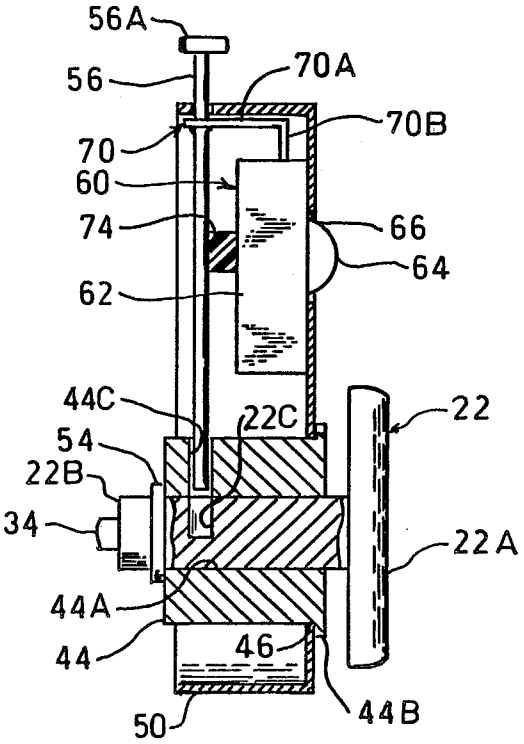
FIG. 5 is a sectional view which is similar to that of FIG. 2 but showing the lock mechanism in condition for operation of the latch bolt by the turn piece.

Novel means for preventing actuation of the latch bolt 16 by the turn piece 22 when desired now will be described. The turn piece 22, as best seen in FIGS. 2 and 5, includes a knob 22A with an integral cylindrical shaft 22B which extends through a cylindrical bore 44A in a turn piece housing 44 for rotatable support of the turn piece in the housing. Turn piece housing 44, in turn, extends through an aperture 46 formed in an interior escutcheon plate 50, and a radial flange 44B at the outer face of the housing abuts the face of escutcheon plate 50 at the periphery of aperture 46. Mounting screws 52,52, which may be of the non-removable type, extend through apertures in turn piece housing 44 and in latch bar housing 30, and threadedly engage tapped holes formed in the cylinder lock housing 36 for holding the escutcheon plate 50, turn piece assembly, and cylinder lock 20 in position on the door 12. Axial movement of the turn piece 22 relative to turn piece housing 44 is prevented by the knob 22A and a locking ring 54 on the shaft 22B at the inner side thereof.

As best seen in FIGS. 2 and 5, the turn piece housing 44 is formed with a radially extending aperture 44C which extends from the outer wall thereof to bore 44A. The shank 22B of turn piece 22 is formed with a bore, or cavity, 22C which is axially alignable with aperture 44C, as shown in FIGS. 2 and 5, by rotation of the turn piece. The inner end of a manually movable latching member 56 extends into aperture 44C in housing 44 and, as seen in FIG. 2, is movable into cavity 22C formed in turn piece 22 to lock the turn piece against rotation. The illustrated latching member 56 is in the form of an axially movable pin, or rod, which extends through an aperture 50A in escutcheon plate 50, and has a knob 56A at the outer end for finger gripping. With the turn piece locked against rotation, operation of the latch bolt 16 by the turn piece is prevented, and niether locking nor unlocking operations of the lock mechanism by the turn piece is possible. With the latching member 56 in the raised position, shown in FIG. 5, the turn piece is free for rotation and may be used for both retracting and extending the latch bolt 16.

Figure 4:
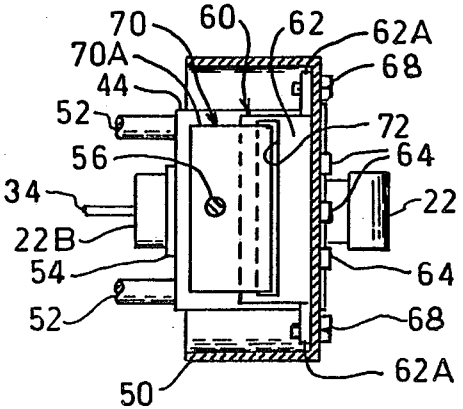
FIG. 4 is a sectional view taken along line 4—4 of FIG. 2.
Figure 3:
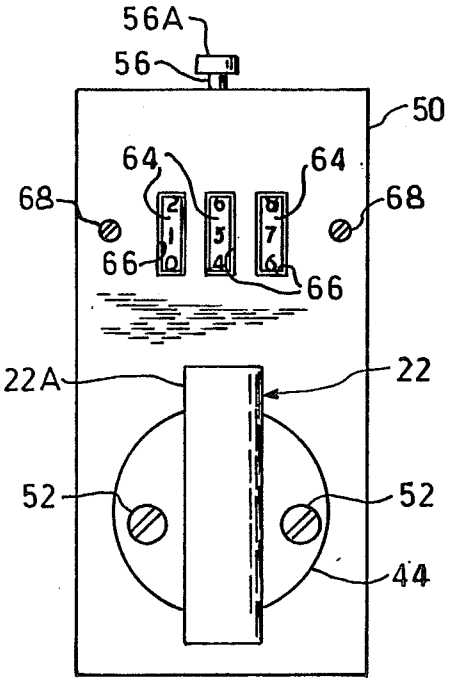
FIG. 3 is an elevational view of the turn piece portion of the lock mechanism.

In accordance with the present invention, locking means 60 are provided for locking the latching member 56 in the lowered position wherein operation of the lock mechanism by the turn piece is prevented. In the illustrated arrangement locking means 60 comprises a combination lock which includes a generally rectangular-shaped housing 62 having an array of dials 64 rotatably mounted therein and extending through openings in a face thereof. Each dial has a series of indicia, such as numerals, along the outer periphery thereof, and portions of the dials extend through apertures 66 in the escutcheon plate 50 for finger rotation thereof. Screws 68 extending through the escutcheon plate engage mounting brackets, or ears 62A, 62A (see FIG. 4) on the housing 62 for attachment of locking means 60 to the inner wall of the escutcheon plate. Locking means 60 may be of a conventional type which is commercially available. Such locks often are employed on luggage and briefcases for locking the same, when desired.

Locking means 60 includes a strike plate 70 which is fixedly secured to the latching member 56 as by welding, or the like. Strike plate 70 is formed with a right-angle bend and includes a horizontal section, 70A attached to the latching member 56 and a vertical section 70B which extends downwardly into locking means 60 through an aperture 72 (FIG. 4) in the upper wall of housing 62 thereof. The lower free end of the vertical section 70B of strike plate 70 may be formed with a pair of opposed arms releasably engageable with associated latching mechanism inside housing 62. When the dials 64 are rotated such that the lock-opening combination of numbers shows through apertures 66, the strike plate 70 is freely movable between the lowered and raised positions shown in FIGS. 2 and 5, respectively. With the strike plate 70 in the lowered position shown in FIG. 2, and with the dials 64 rotated to a non-open combination of numbers, the combination lock remains in the locked condition until the dials 64 are rotated into the lock-opening combination of positions. A non-open combination of numbers comprises every combination of numbers except the lock-opening combination of numbers. Only when dials 64 are rotated to the lock-opening combination of numbers is the strike plate 70 free for movement from the lowered position thereof shown in FIG. 2 to the raised position thereof shown in FIG. 5. As noted above, the combination lock dials 64 extend through apertures 66 in the escutcheon plate 50 for ready access to the user for rotation between the lock-opening combination of numbers and any of the non-opening combination of numbers. A resilient friction pad 74 is affixed to the rear wall of housing 62 of combination lock 60 and engages latching member 56 to prevent inadvertent gravity actuation thereof. Alternative means, such as a flexible wire which frictionally engages the latching member 56, may be used to prevent axial movement of latching member 56 except by use of a positive force applied thereto. A positive up or down manual force on the latching member 56 is required for movement thereof between lowered and raised positions thereof.

Although the operation of the lock mechanism is believed to be apparent from the above description, a brief description thereof now will be provided. In one operating mode, the mechanism functions as a conventional single cylinder dead bolt lock with turn piece. If, for example, the occupant wants to leave through the door and desires that the door be locked from the outside and unlocked from the inside, latching member 56 is moved to the raised position wherein rotation of the turn piece is enabled. After exiting through the door, the door is locked by use of key 42. It may be unlocked from the outside by use of the key, or from the inside by use of the turn piece.

If the occupant wants to leave the turn piece in an inoperative condition so unauthorized persons can not exit through the door, the turn piece is rotated to the position illustrated in FIG. 5 wherein cavity 22C in shank 22B of the turn piece is in axial alignment with aperture 44C in turn piece housing 44. Rotation of the turn piece into this position without actuation of the latch bolt 16 is made possible by inclusion of the conventional lost-motion connection between the turn piece and spindle 34. With apertures 22C and 44C in axial alignment, latching member 56 is pushed downwardly wherein the end thereof enters aperture 22C thereby preventing rotation of the turn piece. Also, numerals on the dials 64 of combination lock 62 are checked to be sure that they are not set to the lock-open combination. Now, after exiting through the door, and locking the same by use of the key 42, the turn piece remains locked. Unauthorized persons without knowledge of the combination of lock 62 are unable to open the deadbolt from inside the structure. However, the lock may be opened from the outside by use of the key, 42, or from the inside by a person having knowledge of the combination of lock 62 to allow for release of latch member 56.

The present lock mechanism allows for locking and unlocking of the door from the inside thereby allowing for exit of the occupant from a second door. Locking of the door from the inside so that unauthorized persons can not exit therethrough, is accomplished by first rotating the turn piece 22 so as to extend the latch bolt 16. Because of the lost-motion connection between the turn piece 22 and spindle bar 34, the turn piece may be returned to the position illustrated in FIG. 5 which allows for actuation of latching member 56 into locking position, shown in FIG. 2. With this movement, strike plate 70 is further lowered into the combination lock housing 62. If the combination is set to open the lock, i.e. to the lock-opening combination of numbers, dials 64 must be rotated to a non-open combination of numbers after downward movement of the strike plate into the housing to lock the strike plate in the lowered position shown in FIG. 2.

Having locked the door from the inside, the occupant then may leave the premises through a second door. Upon returning, the occupant may reenter the premises through the second door and after rotating dials 64 to lock-open condition, latch member 56 may be raised and turn piece 22 rotated for movement of the latch bolt 16 from the extended to the retracted position. The previously locked door now has been unlocked from the inside, thereby allowing the occupant to exit through the door.

The invention having been described in detail, various changes and modification will suggest themselves to those skilled in this art. For example, locks other than the illustrated combination lock may be used for preventing movement of the latching member 56 in the locked condition. Also, other latching members 56, such as pivotal latching members which pivot between latched and unlatched conditions may be employed. Also, other means for disabling operation of the turn piece may be used in place of a latching member. For example, the turn piece may be disabled by disconnection thereof from the spindle bar 34 through suitable manually controlled connecting means, together with provision for locking the connecting means in the disconnected condition as by use of a combination lock. In addition, a latch unit which includes first and second cranks which are operatively connected to said spindle bar means 32 and 34, respectively, may be employed in place of latch unit 14. Operation of the turn piece may be disabled by disabling the connection of the turn piece to the associated crank at any point along the connection therebetween, and not only by direct engagement of the turn piece 22 by the manually movable latching means 56. Furthermore, it will be apparent that the invention is not limited to use with locks having a horizontally movable latch bolt 16. For example, the invention may be used with locks of the type which include one or more vertically movable latch bolts. Surface mounted locks with which the invention may be employed include either horizontally or vertically movable latch bolts. It is intended that the above and other such changes and modifications shall fall within the spirit and scope of the invention as defined in the appended claims.

I claim:

1. A lock mechanism comprising, a key operated lock cylinder at one side thereof, a turn piece at the opposite side thereof, a latch bolt operated by rotation of said cylinder by a key and by rotation of said turn piece, lost-motion connections between said latch bolt and cylinder and between said latch bolt and turn piece to allow for independent operation of said latch bolt by either said cylinder or turn piece, manually movable means operable from said opposite side of the lock mechanism and movable between a first position for preventing operation of the latch bolt by said turn piece and a second position allowing for operation of the latch bolt by the turn piece, and locking means operable from said opposite side of the lock mechanism for locking the manually movable means in said first position.

2. A lock mechanism as defined in claim 1 wherein said locking means comprises a combination lock.

3. A lock mechanism as defined in claim 2 wherein said combination lock includes a plurality of dials with indicia at the periphery thereof.

4. A lock mechanism as defined in claim 1 wherein said manually movable means comprises a latch member movable into engagement with the turn piece in the first position thereof to prevent rotation of the turn piece and movable out of engagement with the turn piece in the second position to allow for rotation of the turn piece.

5. A lock mechanism as defined in claim 4 wherein said locking means comprises a combination lock.

6. A lock mechanism as defined in claim 4 including a fixed member formed with a bore therethrough for rotatable support of said turn piece, said fixed member being formed with an aperture extending radially of the bore, said turn piece being formed with a cavity that is axially alignable with the radially extending aperture in the fixed member by rotation of the turn piece, and said manually movable means comprising an axially movable pin extending into the radially extending aperture in the fixed member and movable axially into the cavity in the turn piece when the cavity and radially extending aperture are in axial alignment.

7. A lock mechanism as defined in claim 6 wherein said locking means is operable between locking and unlocking conditions, said locking means including a strike plate fixedly attached to the manually movable means for movement therewith, said strike plate being locked in position by said locking means when the axially movable pin is extended into the cavity in the turn piece and the locking means is in locked condition.

8. A lock mechanism comprising, a key operated rotatable cylinder at one side thereof, a rotatably mounted turn piece at the opposite side thereof, a latch bolt movable between retracted and extended positions by rotation of said key operated cylinder and by rotation of said turn piece, lost-motion connections between said latch bolt and cylinder and between said latch bolt and turn piece to allow for independent operation of said latch bolt by either said cylinder or turn piece, a manually movable latching member operable from said opposite side of the lock mechanism and movable between first and second positions wherein said turn piece is prevented from rotation and is free for rotation, respectively, and locking means operable from said opposite side of the lock mechanism for locking the latching member in said first position wherein rotation of the turn piece is prevented thereby preventing movement of the latch bolt between retracted and extended positions by operation of the turn piece.

9. A lock mechanism as defined in claim 8 wherein said locking means comprises a combination lock having a plurality of rotatable dials with indicia at the periphery thereof.

* * * * *